US008412067B2

(12) United States Patent
Watanabe et al.

(10) Patent No.: US 8,412,067 B2
(45) Date of Patent: Apr. 2, 2013

(54) LASER FIXING DEVICE AND IMAGE FORMING APPARATUS

(75) Inventors: Miho Watanabe, Kanagawa (JP); Makoto Furuki, Kanagawa (JP); Naoyuki Egusa, Kanagawa (JP); Tetsuro Kodera, Kanagawa (JP); Takashi Matsubara, Kanagawa (JP); Shinji Hasegawa, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 394 days.

(21) Appl. No.: 12/728,398

(22) Filed: Mar. 22, 2010

(65) Prior Publication Data

US 2011/0064448 A1 Mar. 17, 2011

(30) Foreign Application Priority Data

Sep. 14, 2009 (JP) ..... 2009-212425

(51) Int. Cl.
*G03G 21/20* (2006.01)
*G03G 15/20* (2006.01)

(52) U.S. Cl. ..... 399/92; 399/336

(58) Field of Classification Search ..... 399/92, 399/122, 320, 335, 336
See application file for complete search history.

(56) References Cited

U.S. PATENT DOCUMENTS

| | | | | |
|---|---|---|---|---|
| 5,436,710 | A | 7/1995 | Uchiyama | |
| 2003/0147666 | A1 | 8/2003 | Miyakoshi et al. | |
| 2006/0216081 | A1 | 9/2006 | Sanpei et al. | |
| 2011/0044740 | A1 * | 2/2011 | Matsubara et al. | 399/335 |
| 2011/0044741 | A1 * | 2/2011 | Matsubara et al. | 399/335 |
| 2011/0158721 | A1 * | 6/2011 | Matsubara et al. | 399/336 |
| 2011/0222936 | A1 * | 9/2011 | Matsubara et al. | 399/336 |
| 2012/0076557 | A1 * | 3/2012 | Matsubara et al. | 399/336 |
| 2012/0093552 | A1 * | 4/2012 | Kodera et al. | 399/336 |

FOREIGN PATENT DOCUMENTS

| | | | |
|---|---|---|---|
| JP | 55-060975 | A | 5/1980 |
| JP | 59-128569 | A | 7/1984 |
| JP | 02-272593 | A | 11/1990 |
| JP | 07-013457 | A | 1/1995 |
| JP | 3016685 | A | 12/1999 |
| JP | 2007-057903 | A | 3/2007 |

OTHER PUBLICATIONS

European Search Report, dated Dec. 15, 2010, issued in Application No. 10156661.0.

* cited by examiner

*Primary Examiner* — Walter L Lindsay, Jr.
*Assistant Examiner* — Rodney Bonnette
(74) *Attorney, Agent, or Firm* — Sughrue Mion, PLLC

(57) ABSTRACT

According to an aspect of the invention, a laser fixing device includes a laser beam generating device and an airflow generating unit. The laser beam generating device generates laser beams and irradiates a recording medium transported with the laser beams. The airflow generating unit generates airflow flowing between the laser beam generating device and the recording medium. A flow speed of the airflow in a transport direction of the recording medium in an irradiation position of the laser beams is higher than a transport speed of the recording medium.

4 Claims, 8 Drawing Sheets

LASER FIXING DEVICE AND IMAGE FORMING APPARATUS

CROSS-REFERENCE TO RELATED APPLICATIONS

This application is based upon and claims priority under 35 USC 119 from Japanese Patent Application No. 2009-212425, filed Sep. 14, 2009.

BACKGROUND

1. Technical Field

The present invention relates to a laser fixing device and an image forming apparatus.

2. Related Art

Image forming apparatuses using a powder-type toner are widely used, which transfer a toner image formed by attaching toner to the surface of a recording medium and heat the toner image so as to be fixed. As the types of fixing the toner image, a contact type and a non-contact type are known.

The fixing device of the contact type includes: a heating member, for example, having an endless peripheral surface to be heated; and a pressurizing member that is brought into contact with the heating member. Such a fixing device applies heat and pressure to a toner image while a recording medium is interposed between the heating member and the pressurizing member, and thereby fixing the toner image on the recording medium.

On the other hand, a fixing device of the non-contact type is not brought into contact with the recording medium. Thus, the fixing device of the non-contact type, compared to the above-described contact-type device, has superior versatility with the recording medium and realize high-speed processing. As such a non-contact type fixing device, there is a device that heats a toner image formed on the transported recording medium so as to be fixed by intermittently turning on a flash lamp disposed so as to face the transport path of the recording medium.

SUMMARY OF THE INVENTION

According to an aspect of the invention, a laser fixing device includes a laser beam generating device and an airflow generating unit. The laser beam generating device generates laser beams and irradiates a recording medium transported with the laser beams. The airflow generating unit generates airflow flowing between the laser beam generating device and the recording medium. A flow speed of the airflow in a transport direction of the recording medium in an irradiation position of the laser beams is higher than a transport speed of the recording medium.

BRIEF DESCRIPTION OF THE DRAWINGS

Exemplary embodiments of the invention will be described in detail based on the following figures, wherein.

DETAILED DESCRIPTION

Embodiments of the present invention will be described with reference to drawings.

Figure 1:
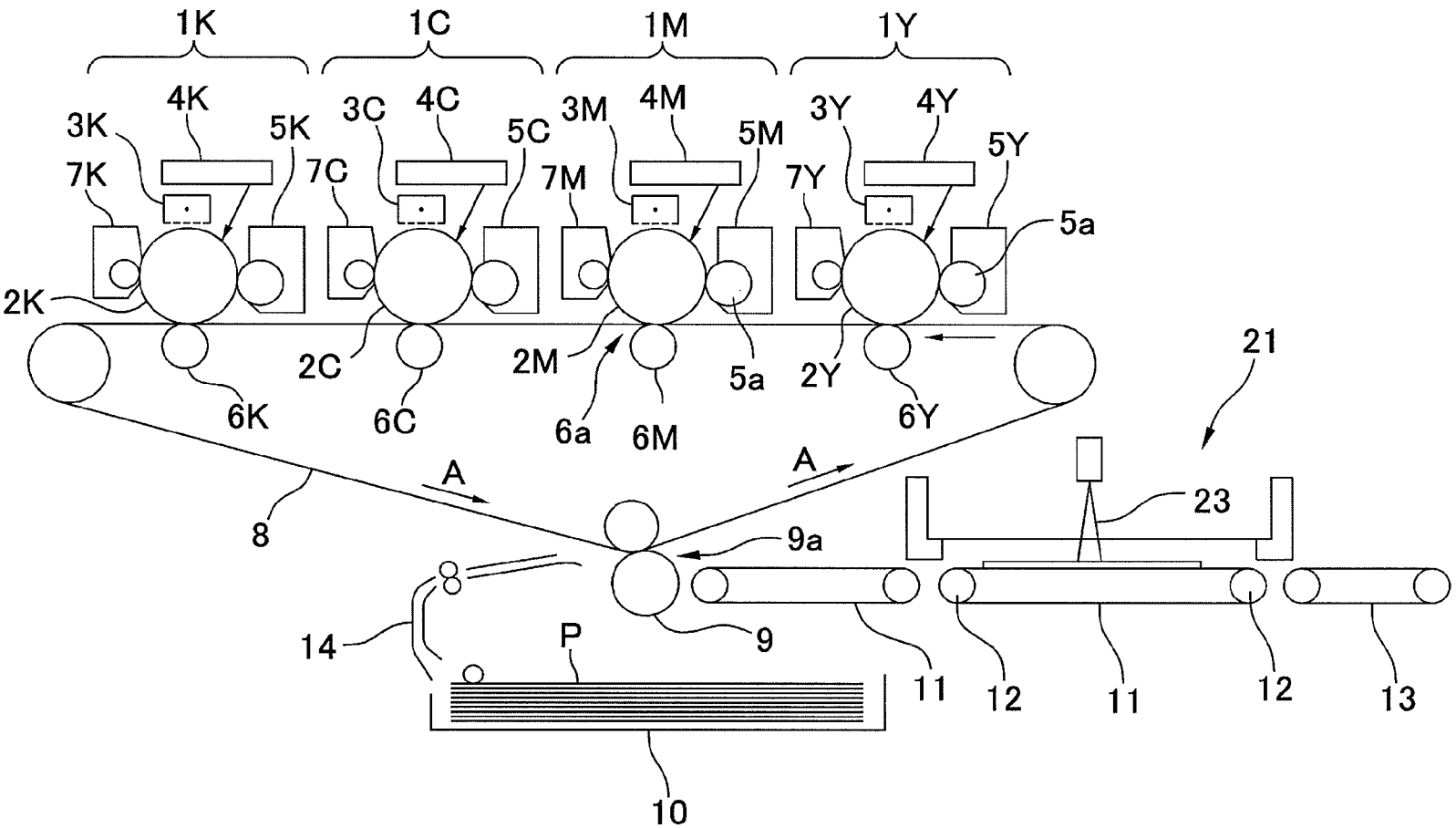
FIG. 1 is a schematic configuration diagram of an image forming apparatus according to an exemplary embodiment of the present invention.

FIG. 1 is a schematic configuration diagram of an image forming apparatus according to an exemplary embodiment of the present invention.

This image forming apparatus is a full-color image forming apparatus including four image forming units 1Y, 1M, 1C, and 1K that output images of colors including yellow (Y), magenta (M), cyan (C), and black (K). These image forming units 1 are disposed so as to face an endless intermediate transfer belt 8 that is stretched so as to allow the peripheral surface thereof to rotate. The image forming units 1 are configured to be able to sequentially output a yellow image, a magenta image, a cyan image, and a black image from the upstream side in the rotation direction of the intermediate transfer belt 8.

Each image forming unit 1 includes a photosensitive drum 2 acquired by forming a photoconductive layer on the outer circumferential surface of a cylindrical member that is formed from a conductive material. In addition, on the periphery of the photosensitive drum 2, each image forming unit 1 includes: a charging device 3 that uniformly charges the surface of the photosensitive drum 2; an exposure device 4 that forms a latent image on the surface of the photosensitive drum 2 by irradiating image light to the charged photosensitive drum 2; a developing device 5 that forms a toner image by transferring toner to the latent image formed on the photosensitive drum; a transfer roll 6 that is disposed to face the photosensitive drum 2 and transfers the toner image formed on the photosensitive drum to an intermediate transfer body; and a cleaning device 7 that eliminates toner that remains on the photosensitive drum 2 after transfer of the toner image.

The colors of toner housed in the developing devices 5 of four image forming units 1Y, 1M, 1C, and 1K are different from one another. However, the other configurations of the image forming units 1Y, 1M, 1C, and 1K are the same with one another.

On the downstream side of a position, in which the image forming units 1 are formed, in a direction in which the peripheral surface of the intermediate transfer belt 8 is moved, a secondary transfer roll 9 that is used for performing secondary transfer is disposed so as to face the intermediate transfer belt 8. A recording sheet P is fed in a secondary transfer unit 9*a* from a sheet tray 10 through a transport path 14.

On the downstream side of the secondary transfer unit 9*a* in the transport direction of the recording sheet, a laser fixing device 21 that fixes an unfixed toner image transferred on a recording sheet is disposed. In addition, on the downstream side, a paper discharge tray (not shown) that houses a recording sheet on which the toner image is fixed is disposed. From the secondary transfer unit 9*a* to the laser fixing device 21, the recording sheet is transported by a transport belt 11 that is rotated while being stretched around a plurality of roll-shaped members 12. To the recording sheet transported on the transport belt, a laser beam is irradiated.

In such an image forming apparatus, when an image forming operation is started, the photosensitive drum 2 is electrically charged with negative polarity almost uniformly by the charging device 3. The exposure device 4 irradiates image light onto the peripheral surface of the charged photosensitive drum 2 based on image data, and accordingly, a latent image is formed on the surface of the photosensitive drum 2 in accordance with electric potential differences between exposed portions and unexposed portions. In the developing device 5, a thin layer of developer is formed on the peripheral surface of the developing roll 5*a*, and the developer formed as a thin film in accordance with the rotation of the developing roll 5*a* is transported to a developing position facing the peripheral surface of the photosensitive drum 2. In the developing position, an electric field is formed between the photosensitive drum 2 and the developing roll 5*a*. Accordingly, the toner disposed on the developing roll is transferred to the latent image formed on the photosensitive drum within the electric filed, and thereby a toner image is formed. The toner image formed as described above is transported to a transfer contact portion 6*a*, in which the transfer roll 6 is in contact with the photosensitive drum 2, in accordance with the rotation of the photosensitive drum 2.

In the transfer contact portion 6*a*, an electric field is formed in accordance with application of a transfer bias voltage, and the toner image is transferred to the intermediate transfer body 8 within the electric field. By being rotated, the intermediate transfer body 8 is sequentially transported to the transfer contact portions 6*a* of the image forming units 1. Accordingly, the toner images of each color are transferred in an overlapping manner. Then, the toner image formed on the intermediate transfer body is moved to a secondary transfer portion 9*a* that faces the secondary transfer roll 9.

On the other hand, the recording sheet P transported from the sheet tray 10 is fed in the secondary transfer portion 9*a* through the transport path 14. In the secondary transfer portion 9*a*, an electric field is formed between the secondary transfer roll 9 and the intermediate transfer body 8, the toner images of colors overlapped with one another are transferred together on the recording sheet P.

The recording sheet P, to which the toner image is transferred, is placed on the transport belt 11 in the state in which the toner image is maintained on the surface thereof and is transported to the laser fixing device 21. In the laser fixing device 21, laser beams 23 are irradiated onto the recording sheet P, and thereby the toner is heated so as to be fixed. The recording sheet P to which the toner image is fixed is discharged to the paper discharge tray (not shown) by a paper discharge belt 13.

Next, the laser fixing device 21 that is used in the above-described image forming apparatus will be described.

Figure 2:
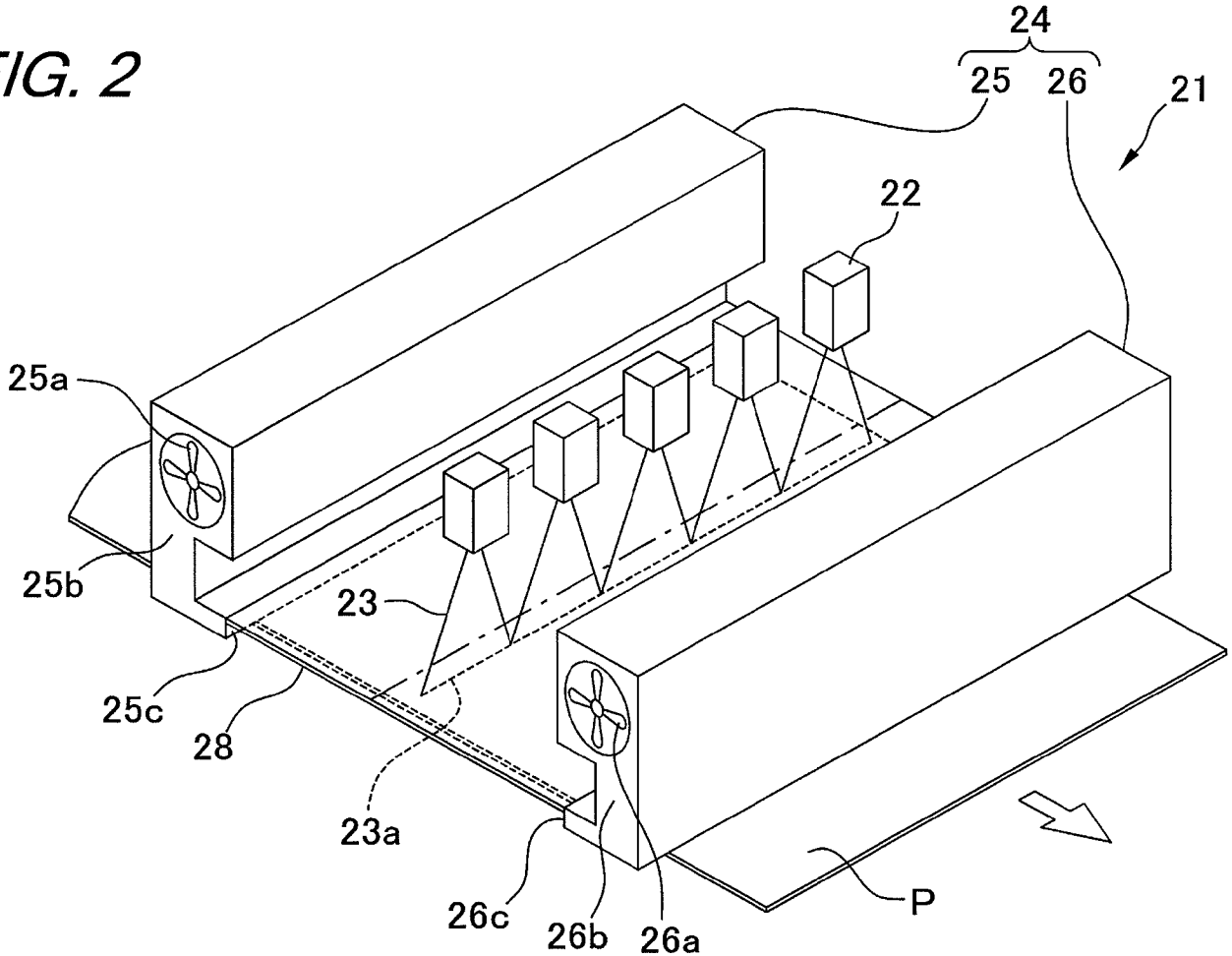
FIG. 2 is a schematic perspective view of a laser fixing device according to an exemplary embodiment of the present invention as the laser fixing device used in the image forming apparatus shown in FIG. 1.
Figure 3:
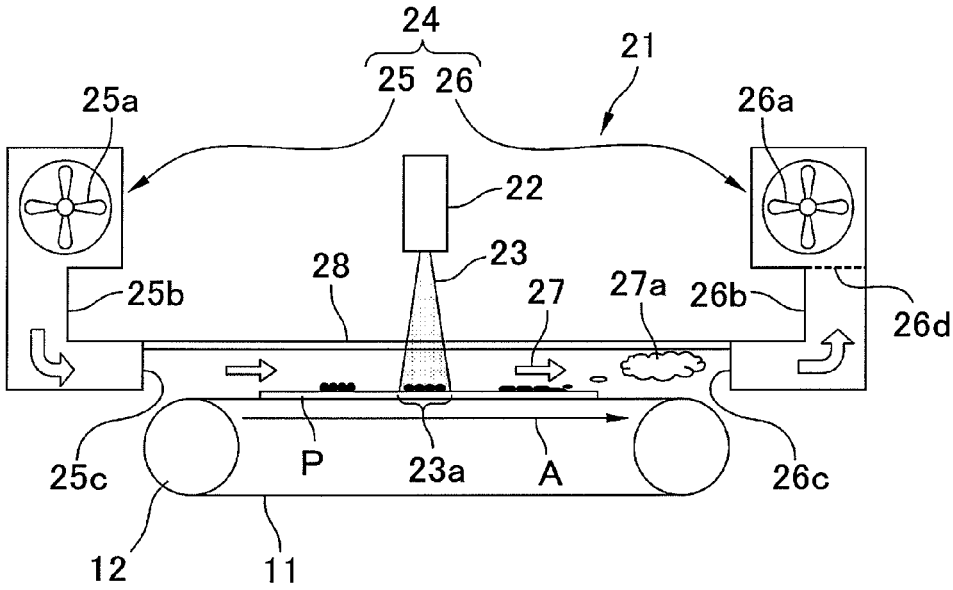
FIG. 3 is a schematic cross-sectional view of the laser fixing device shown in FIG. 2.

FIG. 2 is a schematic perspective view of a laser fixing device according to an exemplary embodiment of the present invention. FIG. 3 is a schematic cross-sectional view of the laser fixing device.

The laser fixing device 21 is configured by a laser beam generating device 22 that irradiates laser beams 23 onto a transported recording sheet P, an airflow generating device 24 that generates airflow from the upstream side of the transport direction of the recording sheet toward the downstream side thereof, and a glass plate 28 that is a plate-shaped member used for forming the flow path of the airflow 27, as its major components.

A plurality of the laser beam generating devices 22 are arranged in the width direction of the recording sheet P. The laser beams 23 output from the laser beam generating devices 22 irradiate a range that is set in advance in the movement direction of the recording sheet P. In addition, in the width direction of the moving recording sheet P, the laser beams are irradiated over the entire width of the area in which the image is transferred. The plurality of laser beam generating devices 22 are disposed such that irradiation energy is almost uniform in the width direction. The irradiation energy is adjusted such that the toner passing through the irradiation area of the laser beams 23 is heated so as to be fixed on the recording sheet P.

In this exemplary embodiment, a semiconductor laser is used, and the laser beams are configured so as to be able to irradiate with a beam width of about 1 mm in the transport direction of the recording sheet P.

The irradiation range of the laser beams is appropriately changed.

The glass plate 28 is disposed between the laser beam generating devices 22 and the transported recording sheet P. In addition, the glass plate 28 is disposed so as to be approximately parallel to the recording sheet P that is moved together with the transport belt 11. The laser beams 23 output from the laser beam generating devices 22 are transmitted through the glass substrate 28 and irradiate the recording sheet P.

The airflow generating device 24 is arranged so as to create airflow between the transported recording sheet P and the laser beam generating devices 22. A blower device 25 that blows air is disposed on the upstream side in the transport direction of the recording sheet, and a suction device 26 that sucks air is disposed on the downstream side in the transport direction. Accordingly, the airflow 27 is formed from the upstream side of the transport direction of the recording sheet toward the downstream side of the transport direction. An air supply fan 25*a* is included in the blower device 25. Accordingly, external air is introduced by the air supply fan 25*a*, and air is supplied to a space between the recording sheet P transported from an air supply opening 25*c* through a supply air duct 25*b* and the glass plate 28. Similarly in the suction device 26, a suction fan 26*a* and a suction duct 26*b* are disposed. Thus, the air supplied form an air supply opening 25*c* passes through the suction duct 26*b* from the suction opening 26*c* and is discharged externally by the suction fan 26*a*.

In addition, a filter 26*d* is disposed in the suction duct 26*b*, and accordingly, a scattering material 27*a* and the like that are included in the sucked air are eliminated by the filter 26*d*.

As described above, by forming the airflow between the glass plate 28 and the recording sheet P, the flow path of the airflow is formed to be straight in a position near the irradiation position of the laser beams 23 with a nearly uniform cross section, and thereby stable airflow 27 is formed. The speed of the airflow 27 is set such that a component of the speed for the movement direction of the recording sheet P is higher than the transport speed of the transported recording sheet P in the irradiation position 23*a* of the laser beams 23. In addition, the wind speed of the airflow 27 is adjusted such that the unfixed toner image that is attached to the recording sheet P is not scattered by the airflow 27.

In addition, in this exemplary embodiment, both the blower device 25 and the suction device 26 are disposed as the airflow generating device 24. However, only one of the blower device 25 and the suction device 26 may be disposed.

By disposing such an airflow generating device, as described below, the amount of the laser beams, which irradiate the recording medium, that are shielded by scattering materials and the like is decreased.

Figure 9:
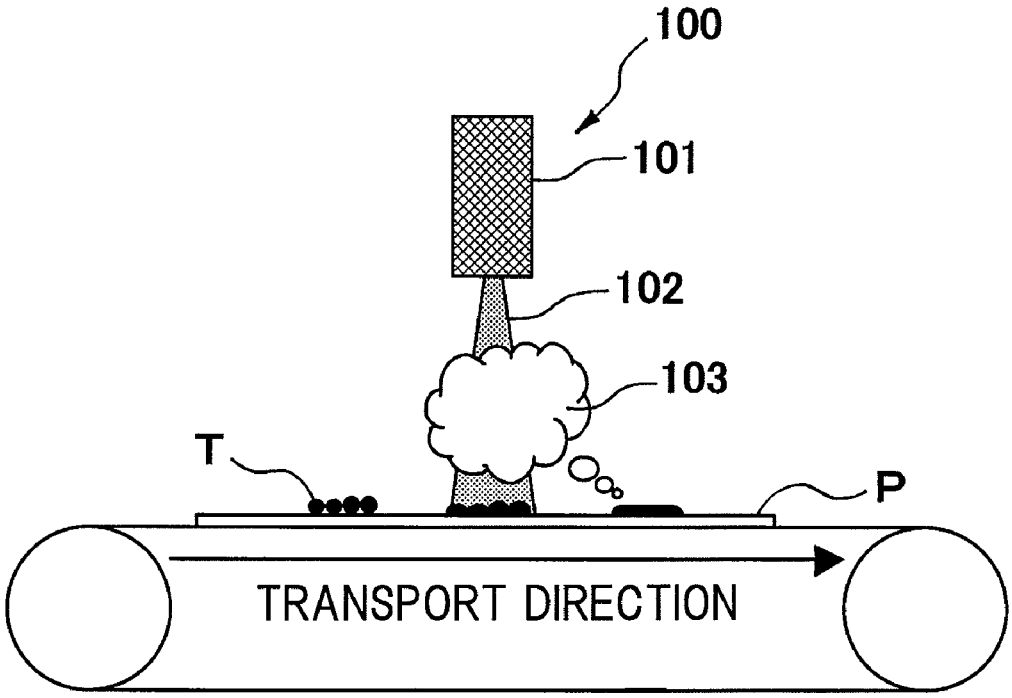
FIG. 9 is a schematic cross-sectional view showing a state in which scattering materials are generated by irradiation of laser beams.

When the laser beams 102 irradiate the toner T disposed on the recording sheet, toner resin, toner volatiles, and the like are scattered due to the heat of the laser beams and may become clouds 103 in the irradiation path of the laser beams 102. When airflow is not generated in the irradiation position of the laser beams, the clouds (scattering materials) 103 do not move in a speedy manner and block the irradiation path of the laser beams 102 as shown in FIG. 9. Accordingly, it is difficult for the laser beams 102 to reach the recording sheet P. Therefore, there is a possibility that the irradiation energy of the laser beams is not sufficiently used for a fixing process.

In addition, even in a case where a laser fixing device including the airflow generating device is used, when the speed of the airflow is lower than the transport speed of the recording sheet near the irradiation position of the laser beams, the unfixed toner image is fed on the rear side of the generated clouds, and thereby the irradiation energy for fixing an image is blocked.

According to this exemplary embodiment, the speed of the airflow 27 in the irradiation position 23*a* of the laser beams 23 and positions near the irradiation position 23 is set such that the component of the speed for the transport direction of the recording sheet is higher than the transport speed of the recording sheet. Accordingly, even in a case where the toner resin and the like fly so as to become clouds, the scattering materials 27*a* are moved to the downstream side of the irradiation position in a speedy manner. Accordingly, a state in which the clouds are eliminated is maintained in the irradiation path of the laser beams 23 toward the recording sheet P. Therefore, shielding of the laser beams 23 by the clouds is prevented.

Next, a laser fixing device according to a second exemplary embodiment of the present invention will be described with reference to FIG. 4.

The laser fixing device 31, similarly to the first exemplary embodiment, is configured by a laser beam generating device 32 that irradiates laser beams 33 onto a moved recording sheet P, an airflow generating device 34 that generates airflow from the upstream side of the movement direction of the recording sheet P toward the downstream side thereof, and a plate-shaped member 38 used for forming the flow path of the airflow, as its major components.

In addition, the laser beam generating device 32 and the airflow generating device 34 have the same configurations as those of the first exemplary embodiment. Thus, the description thereof is omitted here.

Figure 4:
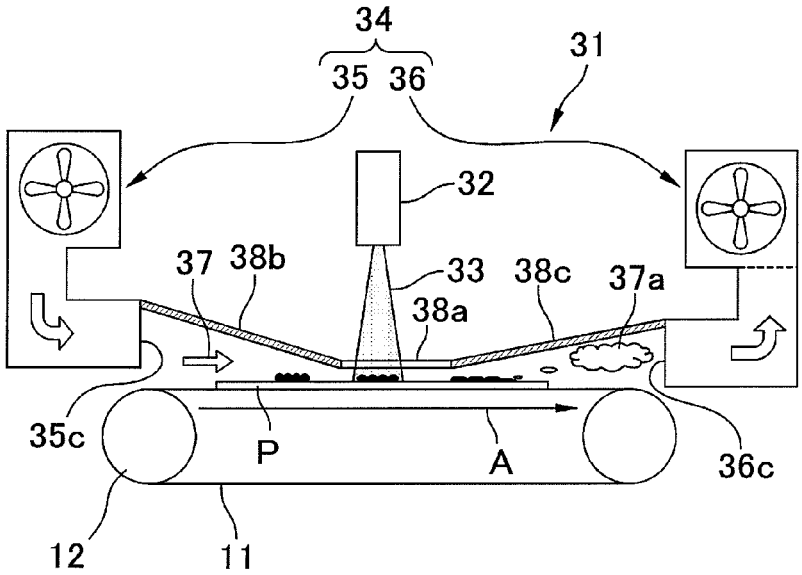
FIG. 4 is a schematic cross-sectional view of a laser fixing device according to a second exemplary embodiment of the present invention.

The above-described plate-shaped member 38, as shown in FIG. 4, connects an upper portion of an air supply opening 35*c* of a blower device 35 and an upper portion of a suction opening 36*c* of a suction device 36 together. The plate-shaped member 38 is disposed so as to face almost the entire width of the transported recording sheet P. In addition, the position in which the laser beams 33 are incident to the plate-shaped member 38 and positions near the incident position are formed from glass so as to be a transparent portion 38*a*. Thus, the laser beams 33 are transmitted through the transparent portion 38*a* and irradiate the recording sheet P.

The transparent portion 38*a* that is formed from a glass member is supported so as to be approximately parallel to the transported recording sheet P. Accordingly, the upstream side 38*b* is disposed such that a gap between the upstream side 38*b* and the recording sheet P is increased toward the air supply opening 35*c*. In addition, similarly, the downstream side 38*c* is disposed such that a gap between the downstream side 38*c* and the recording sheet P is increased from the transparent portion 38*a* toward the suction opening 36*c*.

In a situation that the recording sheet P is not transported by the transport belt 11, the transparent portion 38*a* is supported so as to be approximately parallel to a transport portion, on which the recording medium is set, of the transport belt 11. The upstream side 38*b* is disposed so that a gap between the upstream side 38*b* and the transport portion is increased toward the air supply opening 35*c*. Similarly, the downstream side 38*c* is disposed so that a gap between the downstream side 38*c* and the transport portion is increased from the transparent portion 38*a* toward the suction opening 36*c*.

As described above, the flow path of the airflow near the irradiation position of the laser beams 33 is narrower than those of the upstream side and the downstream side of the movement direction of the recording sheet P. Accordingly, it is easy to set the speed of the airflow 37 to be higher than the transport speed of the recording sheet. In addition, it is suppressed that scattering materials and the like are attached to the glass of the transparent portion 38*a*.

In addition, the plate-shaped member 38 of this exemplary embodiment is formed from glass as a transparent body only in the incident portion of the laser beam 33 and a portion near the incident portion, and the other portions are formed by an opaque body. However, the entire plate-shaped member may be formed by a transparent member such as glass.

Next, a laser fixing device according to a third exemplary embodiment of the present invention will be described with reference to FIG. 5.

The laser fixing device 41, similarly to the first exemplary embodiment, is configured by a laser beam generating device 42 that irradiates laser beams onto a moved recording sheet P, an airflow generating device 44 that generates airflow from the upstream side of the movement direction of the recording sheet P toward the downstream side thereof, a glass plate 48 that is a plate-shaped member used for forming the flow path of the airflow, and a light collecting body 49 that is used for collecting scattered light, which is generated by reflecting the laser beams 43 on the recording sheet P, in the primary irradiation position of the recording sheet P or positions near the primary irradiation position, as its major components.

The laser beam generating device 42, the airflow generating device 44 and the glass plate 48 that are the same as those of the first exemplary embodiment are used.

Figure 5:
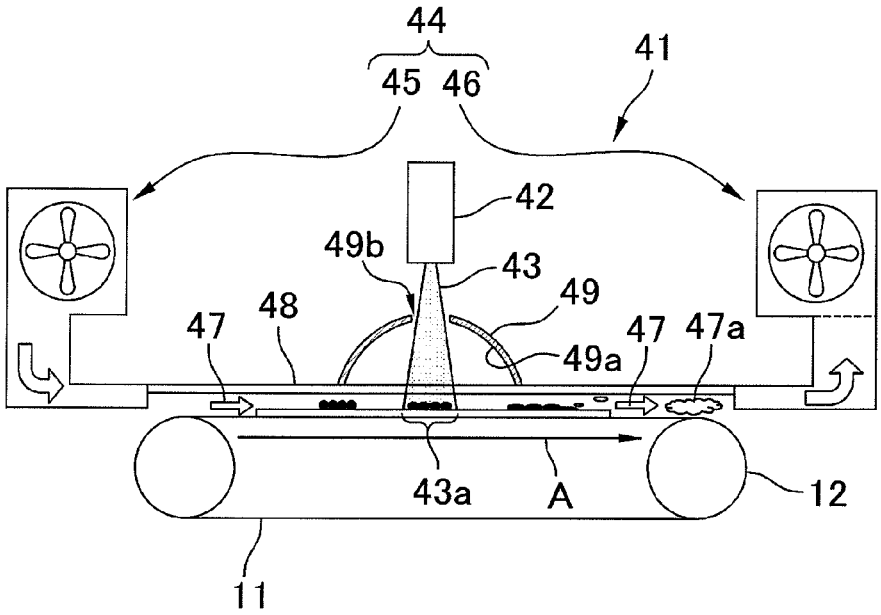
FIG. 5 is a schematic cross-sectional view of a laser fixing device according to a third exemplary embodiment of the present invention.

The light collecting body 49, as shown in FIG. 5, is disposed between the laser beam generating device 42 and the glass plate 48. In addition, both ends of the light collecting body 49 in the circumferential direction are brought into contact with an upper portion of the glass plate 48. The light collecting body 49 is a metal mirror having a cylindrical curved face of a concaved shape used as a reflective surface 49*a*. In addition, the reflective surface 49*a* is disposed so as to face the glass plate 48 and the recording sheet P. In a center portion of the reflective surface 49*a*, that is the cylindrical curved face, a slit 49*b* as an incidence opening of the laser beams 43 is disposed in the axis direction. The laser beams 43 output to the recording sheet P are incident through the slit 49*b* and are transmitted through the glass substrate 48 so as to irradiate onto the recording sheet P.

The light collecting body 49 is supported so as to have a center axis of the cylindrical curved face to be approximately perpendicular to the transport direction of the recording sheet P. The light collecting body 49 covers the entire width of the area in which an image is formed in the width direction of the recording sheet P. In addition, in the movement direction of the recording sheet P, the light collecting body 49 is configured to cover the primary irradiation position 43*a* of the laser beams 43. The position of the center axis of the cylindrical curved face of the light collecting body 49 is set to the primary irradiation position 43*a* in which laser beams are irradiated on the recording sheet P or positions near the primary irradiation position 43*a*. Accordingly, the light collecting body 49 is configured to be able to repeatedly reflect most of scattered light of the laser beams 43, which is irradiated and reflected on the recording sheet, so as to be collected in the primary irradiation position 43*a* or positions near the primary irradiation position 43*a*.

Here, the position of the center axis of the reflective surface 49*a* that is a cylindrical curved face may be deviated more or less from the movement direction of the recording sheet P or a direction perpendicular to the surface of the recording sheet as long as the reflective surface 49*a* can collect the scattered light reflected in the primary irradiation position 43*a* in positions near the primary irradiation position 43*a*.

Here, "to collect light in the primary irradiation position or positions near the primary irradiation position" is to collect light such that the fixing of toner particles in the primary irradiation position is improved particularly for isolated toner by adding the energy of light reflected and collected by the light collecting body to the irradiation energy of the primary irradiation of the laser beams. Accordingly, other than a case where light collected by the light collecting body is precisely irradiated in the primary irradiation position, the light may be irradiated in the primary irradiation position and positions near the primary irradiation position, and the peak position of the energy distribution of irradiation of light collected by the light collecting body may be deviated from the primary irradiation position more or less.

It is preferable that the glass plate 48 is formed such that a gap between the glass plate 48 and the recording sheet P is small so as to create airflow therebetween. By setting the gap between the glass plate 48 and the recording sheet P to be small, a gap between both ends of the light collecting body 49 in the circumferential direction thereof and the recording sheet P is set to be small, and most of the light scattered in the primary irradiation position 43*a* is collected in the primary irradiation position or positions near the primary irradiation position. In addition, by setting the gap to be small, the speed of the formed airflow becomes high at a small amount of blow.

In addition, by disposing the glass plate 48 between the reflective surface 49*a* of the light collecting body and the recording sheet P, the reflective surface 49*a* is prevented from being contaminated even in a case where scattering materials such as resins included in the toner due to irradiation of the laser beams are generated.

Here, the function of the light collecting body 49 will be described.

In the toner image transferred to the recording sheet P, high density portions and low density portions are mixed together. In the high density portion, toner is densely attached to a continuous sheet P. On the other hand, in the low density portion, toner is attached to the continuous sheet in a scattered manner. The scattered toner of the low density portion includes toner in which aggregation of a plurality of toner particles is attached in a scattered manner and toner (hereinafter, referred to as isolated toner) in which one toner particle is attached in an isolated manner.

Figure 8A:
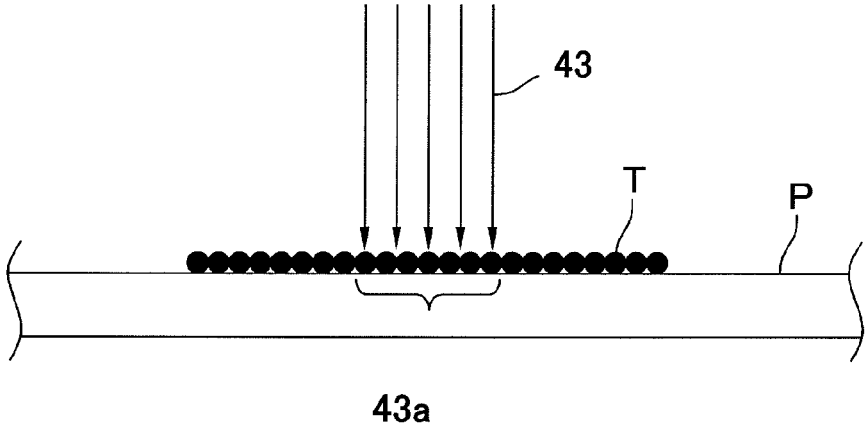
FIGS. 8A and 8B are schematic diagrams showing states in which laser beams are irradiated on a recording sheet on which a toner image is transferred.

Most of the laser beams 43 irradiated from the laser beam generating device 42, as shown in FIG. 8A, are irradiated on the toner particles T in the high density portion. Accordingly, the amount of the scattered light is small. In this state, the output of the irradiation energy of the laser beam generating device 42 is adjusted such that the toner particles T absorb the irradiation energy of the laser beams 43 so as to be heated up to temperature appropriate to fixing.

Figure 8B:
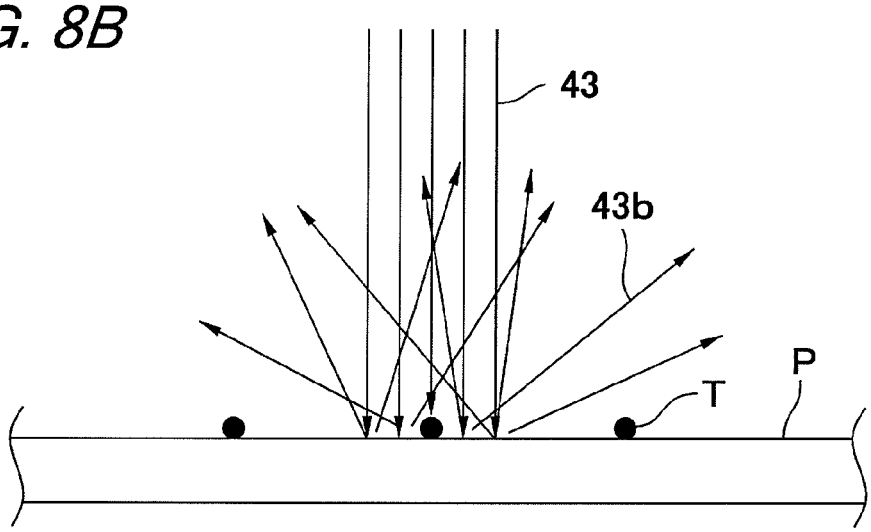

On the other hand, the density of attached toner is low in the low density portion. Thus, as shown in FIG. 8B, the laser beams 43 are irradiated on the toner particles T in the primary irradiation position 43*a* of the laser beams 43, and the laser beams 43 are irradiated on the peripheral portions of the toner particles T so as to be reflected to be scattered light 43*b*. At this time, the irradiation energy of the laser beams 43 that are directly irradiated on the toner particles T is not changed much from that irradiated on the toner particles disposed in the high density portion. However, the surface area of the toner particles that is brought into contact with external air is larger than that of the high density portion in which the toner particles are densely placed. Accordingly, the amount of heat radiation increases, and thereby there are toner particles that are not sufficiently heated. Therefore, defective fixing may easily occur. In particular, defective fixing of the toner that is attached in units of particles of the toner so as to be isolated due to insufficient heating may easily occur.

As described above, there is a possibility that the toner particles disposed in the low density portion may not be sufficiently heated by the irradiation energy of the laser beams so as to be in the unfixed state. The unfixed toner may contaminate the recording sheet or the inside of the device by being attached to the discharge belt or the like.

On the other hand, in a case where the output of the laser beams is set to be high in consideration of the above-described loss of the irradiation energy in the low density portion, the toner particles disposed in the high density portion are heated more than necessary. Accordingly, there is an increased possibility that image defect may be generated in the high density portion or scattering of the toner resin.

In consideration of such situations, according to the laser fixing device 41 of this exemplary embodiment, the irradiation energy of the irradiated laser beams 43 is adjusted to an output level for which fixing is appropriately performed in the high density portion, and the light collecting body 49 is disposed on the front side of the transported recording sheet P. Accordingly, fixing is appropriately performed in the high density portion, and the scattered light 43*b* that is reflected by irradiating the laser beams 43 on the recording sheet P in the primary irradiation position 43*a* is collected in the primary irradiation position 43*a* of the laser beams 43 or positions near the primary irradiation position in the low density portion. As a result, the irradiation energy for the toner particles disposed in the low density portion is increased.

In addition, the absorption rate of the laser beams 43 is high in the high density portion, and the amount of reflected light 43*b* in the primary irradiation portion 43*a* is small. Accordingly, the amount of light that is reflected by the light collecting body 49 and is returned to the primary irradiation position 43*a* is small, and there is a low possibility that the high density portion is excessively heated.

Next, a difference between the light collecting body 49 according to this exemplary embodiment and a mirror of a fixing device using a conventional flash lamp will be described.

Figure 10A:
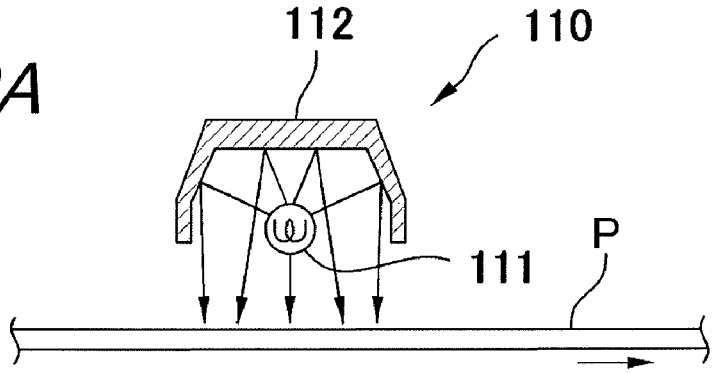
FIGS. 10A and 10B are schematic cross-sectional views showing a conventional flash lamp fixing device.
Figure 10B:
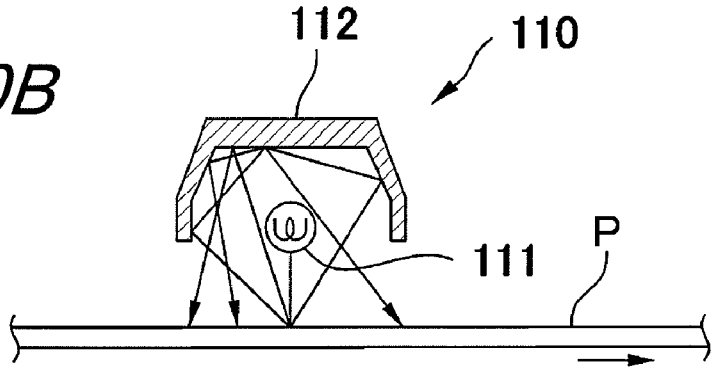

As illustrated in FIGS. 10A and 10B, in a fixing device 110 that uses a conventional flash lamp, a flash lamp 111 is disposed in the width direction of a transported recording sheet P, and a mirror 112 as a reflective body is disposed so as to cover the rear face and the side faces of the flash lamp 111.

This mirror 112, as illustrated in FIG. 10A, reflects light of the flash lamp 111 that emits the light in all directions so as to irradiate a large area facing the flash lamp 111 of the recording sheet P.

In addition, as shown in FIG. 10B, the mirror 112 also has a function for additionally reflecting light, which is irradiated on the recording sheet and is reflected, so as to be irradiated on the recording sheet. However, the light having different incident angles is directly dispersed and reflected, and accordingly, light is not collected in a specific area. Accordingly, the irradiation energy is supplied to an area of the recording sheet P that faces the flash lamp 111 to be approximately uniform. Therefore, even in a case where high density areas and low density areas are mixed together in the recording medium P, the irradiation energy is supplied to be approximately uniform, regardless of the image density.

On the other hand, according to the laser fixing device 41 of this exemplary embodiment, the laser beams 43 are irradiated in a limited primary irradiation position 43*a*. Thus, the light reflected by the surface of the recording sheet is irradiated to be collected in the primary irradiation position 43*a*. In particular, in a case where the image density of the primary irradiation position corresponds to a low density portion, the amount of light reflected by the surface of the recording medium is great. Accordingly, the purpose of installation of the light collecting body 49 is different from that of the mirror of the fixing device using the flash lamp, and the function of the light collecting body 49 is completely different from that of the mirror.

Figure 6:
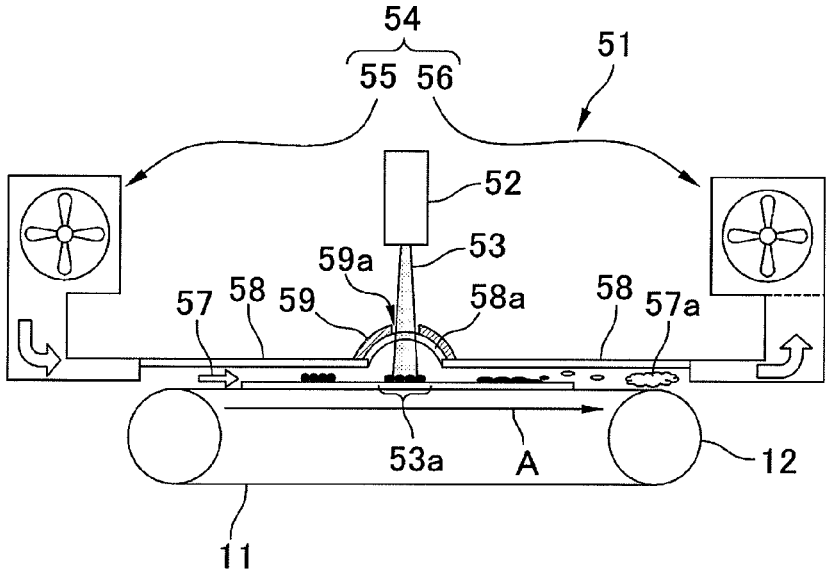
FIG. 6 is a schematic cross-sectional view of a laser fixing device according to a fourth exemplary embodiment of the present invention.

Next, a laser fixing device according to a fourth exemplary embodiment of the present invention will be described with reference to FIG. 6.

The laser fixing device 51, similarly to the third exemplary embodiment, is configured by a laser beam generating device 52 that irradiates laser beams onto a moved recording sheet P, an airflow generating device 54 that generates airflow from the upstream side of the movement direction of the recording sheet P toward the downstream side thereof, a plate-shaped member 58 used for forming the flow path of the airflow, and a light collecting body 59 that is used for collecting scattered light, which is generated by reflecting the laser beams 53 on the recording sheet P, in a position near the primary irradiation position of the recording sheet P, as its major components.

The laser beam generating device 52 and the airflow generating device 54 are the same as those of the third exemplary embodiment. Thus, description thereof is omitted here.

The plate-shaped member 58 is disposed between a recording sheet P that is moved together with a transport belt 11 and the laser beam generating device 52. As shown in FIG. 6, the plate-shaped member 58 is supported so as to be approximately parallel to the recording sheet P. In addition, the plate-shaped member 58 covers almost the entire recording sheet P that is transported. A portion in which the laser beams 53 are incident forms a cylindrical face having a side opposing the recording sheet P to be a concaved shape, and this portion is configured by a glass member 58*a* having an almost uniform thickness. The flat plate portions disposed on the upstream side and the downstream side thereof may be formed of transparent materials or opaque materials.

The glass member 58*a* is supported such that the center axis of the cylindrical curved face is almost perpendicular to the transport direction of the recording sheet P. The position of the center axis is a primary irradiation position 53*a* in which the laser beams 53 are irradiated on the recording sheet P or a position near the primary irradiation position 53*a*.

The light collecting body 59 is formed by coating the outer circumferential face of the glass member 58*a* with a multilayer film formed of a metal, a dielectric body, or the like. A boundary face between the light collecting body 59 and the glass member 58*a* serves as a reflective surface. The light collecting body 59 is not formed in the portion 59*a* in which the laser beams 53 are incident, and the glass member 58*a* is exposed in this portion. Accordingly, the laser beams 53 are configured to be transmitted through the glass member 58*a* so as to be irradiated on the recording sheet P.

The above-described light collecting body 59 that is integrally formed with the glass member 58*a* forming a cylindrical curved face, similarly to the light collecting body 49 according to the third exemplary embodiment, can repeatedly reflect most of the scattered light, which is generated by reflecting the laser beams 53 on the recording sheet, so as to be collected in the primary irradiation position 53*a* or a position near the primary irradiation position 53*a*.

In addition, since the glass member 58*a* is formed in the shape of a cylindrical curved face having the center axis in the primary irradiation position, the incident angle of the scattered light, which is reflected by the recording sheet P, to the glass member 58*a* is set to be close to zero degree. Accordingly, scattering and losing of the irradiation energy due to reflection occurring at the time of incidence to the glass member is decreased.

In addition, the diameter of the cylindrical curved face of the glass member 58*a* is formed to be smaller than that of the light collecting body 49 according to the third exemplary embodiment. Accordingly, a change in the cross section of the flow path of the air flow 57 in the primary irradiation position 53*a* and positions near the primary irradiation position is small. Therefore, the disturbance of the airflow in positions near the primary irradiation position is suppressed, and thereby stable airflow is formed.

Next, a laser fixing device according to a fifth exemplary embodiment of the present invention will be described.

Figure 7A:
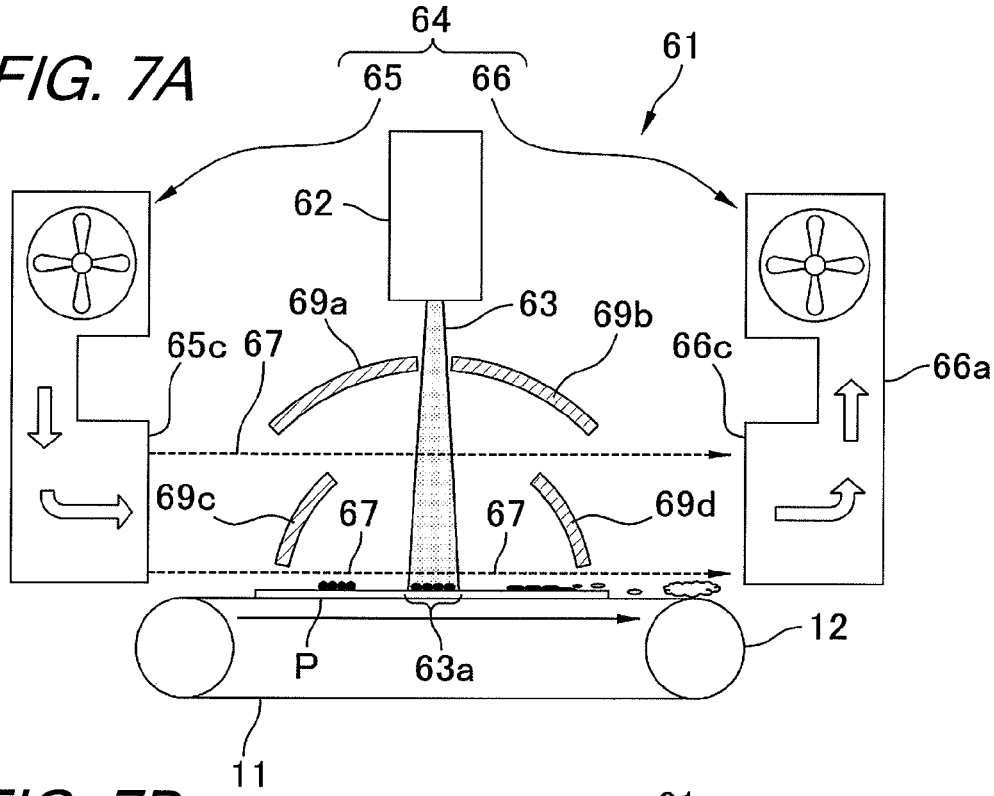
FIGS. 7A and 7B are schematic cross-sectional views of laser fixing devices according to a fifth exemplary embodiment of the present invention.

The laser fixing device 61, as shown in FIG. 7A, is configured by a laser beam generating device 62 that irradiates laser beams 63 onto a moved recording sheet P, an airflow generating device 64 that generates airflow from the upstream side of the movement direction of the recording sheet P toward the downstream side thereof, and a light collecting body 69 that is used for collecting scattered light, which is generated by reflecting the laser beams 63 on the recording sheet P, in the recording sheet P. The above-described laser beam generating device 62 is the same as that used in the first exemplary embodiment.

The light collecting body 69 is disposed between the laser beam generating device 62 and a transported recording sheet P. The light collecting body 69 is divided into four in the irradiation range of the laser beams in the width direction of the recording sheet P, and the laser beams 63 are incident from a gap between the divided light collecting bodies 69*a* and 69*b*.

In addition, the divided light collecting bodies 69*a*, 69*b*, 69*c*, and 69*d*, as shown in FIG. 7A, include divided light collecting bodies of different radiuses. In addition, concave shaped surfaces of the cylindrical curved face that face the recording sheet P are formed as reflective surfaces.

The light collecting bodies 69*a*, 69*b*, 69*c*, and 69*d* have the positions of center axes of the cylindrical curved faces to be the primary irradiation position 63*a* in which laser beams 63 are directly irradiated on the recording sheet P or positions near the primary irradiation position. Accordingly, most of the scattered light generated by being reflected in the primary irradiation position 63*a* of the recording sheet P is reflected by the reflective surfaces so as to be collected near the primary irradiation position of the laser beams 63.

Figure 7B:
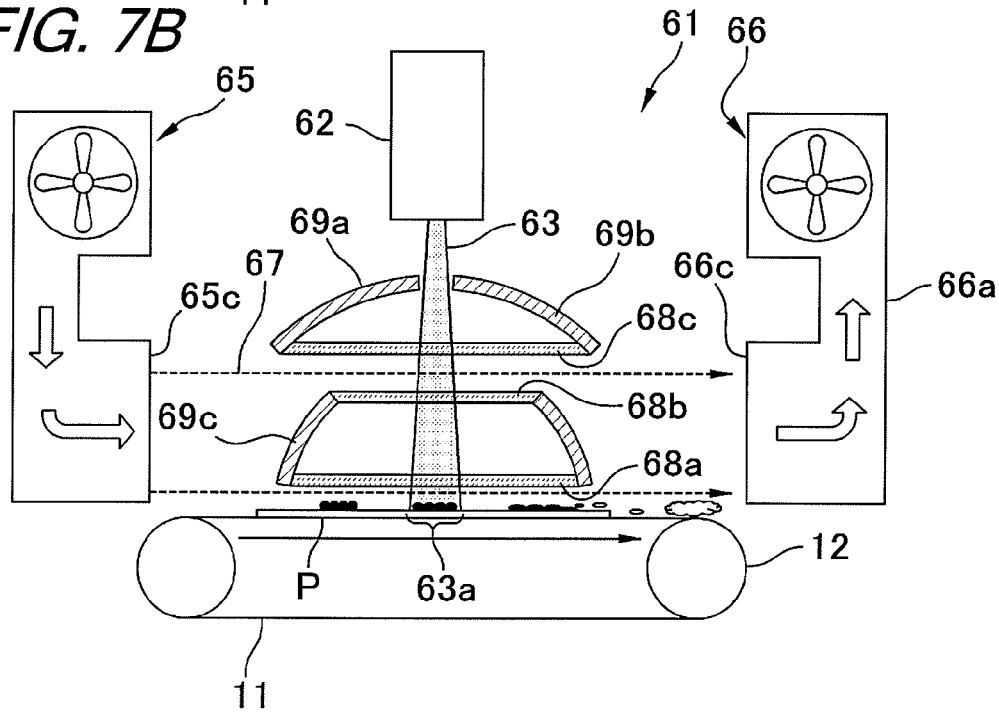

The airflow generating device 64, similarly to that of the first exemplary embodiment, includes a blower device 65 and a suction device 66. The airflow generating device 64 generates airflow 67 from the upstream side of the transport direction of the recording sheet P toward the downstream side thereof. In this exemplary embodiment, as shown in FIGS. 7A and 7B, an air supply opening 65*c* and a suction opening 66*c* are disposed such that airflow is formed between the light collecting bodies 69*c* and 69*d* and the recording sheet P and the divided light collecting bodies. In addition, in an irradiation path in which the laser beams 63 are irradiated on the recording sheet P and in positions near the irradiation path, the component of the speed of the airflow 67 for the transport direction of the recording sheet is set to be higher than the transport speed of the recording sheet. Accordingly, clouds due to scattering of the toner resin and the like are moved to the suction side at a speed higher than that of the movement of the recording sheet, and thereby the clouds do not block the irradiation of the laser beams to unfixed toner disposed on the recording sheet. Therefore, loss of the irradiation energy is suppressed.

In this exemplary embodiment, the light collecting body 69 is divided into four. However, the number of the divided collecting bodies may be changed.

In addition, between end portions of the light collecting bodies 69*c* and 69*d* that are disposed to be close to the transport path of the recording sheet P, a glass plate 68*a* may be supported so as to limit the range in which the airflow is generated. As shown in FIG. 7B, glass plates 68*a*, 68*b*, and 68*c* may be disposed so as to cover the reflective surfaces of the divided light collecting bodies 69*a*, 69*b*, 69*c*, and 69*d*. By covering the reflective surfaces with the glass plates 68*a*, 68*b*, and 68*c*, contamination of the reflective surfaces is prevented. In addition, by stabilizing the air flow formed by the airflow generating device 64, airflow having less disturbance is acquired.

All the laser fixing devices according to the above-described first to fifth exemplary embodiments fix images on recording sheets P by transporting the recording sheets, which have been cut into a size on the basis of general specifications, one by one by using the transport belt 11. However, as a recording medium, continuous paper can be used, and the continuous paper can be transported in a state being rotatably stretched between transport rolls. In such a case, a backup member may be disposed on the rear face side of the irradiation position of the laser beams. Alternatively, the laser beams may be irradiated on the continuous paper in the state being rotatably stretched between the transport rolls without disposing a backup member or the like. In a case where the backup member or the like is not placed, the amount of the laser beams transmitted to the rear face side of the continuous paper is increased. Accordingly, a rear-face side light collecting body that collects the laser beams in the primary irradiation position of the laser beams from the rear face side by reflecting the beams transmitted to the rear face side of the continuous paper may be disposed. In such a case, loss of the irradiation energy can be decreased by effectively using the beams transmitted to the rear face of the continuous paper.

In addition, in a case where the light collecting body is heated by absorbing the scattered light, a heat sink, a chiller, an air-cooling device, or the like may be disposed so as to suppress the heating of the light collecting body.

EXAMPLE

Next, the result of an experiment for testing existence of unevenness of fixing in a laser fixing device equipped with an airflow generating device will be described.

The configuration used in this experiment is as follow.

1. light source of laser fixing device: product name Hight-Light ISL-2000 L manufacture by COHERENT Co. (exposure wavelength: 808 nm)
2. toner containing 0.3% of Squarylium dye as infrared ray absorbent
3. intensity of irradiation=1.0 J/cm$^2$
4. irradiation time: 1 ms
5. transport speed of recording sheet: 1 m/sec
6. suction device disposed on the rear side of transport direction of recording sheet Under the above-described conditions, experiments for fixing a toner image were performed while changing the speed of the airflow in the primary irradiation position of the laser beams and positions near the primary irradiation position. The speeds of the airflow were set such that the component for the transport direction of the recording sheet was lower (lower than 1 m/sec) than the transport speed of the recording sheet or was equal or higher (equal to or higher than 1 m/sec) than the transport speed of the recording sheet. Then, the unevenness of the fixing was visually observed for each case, and the cases are compared together.

The results were as follows. There was no unevenness of the fixing in the case where airflow having the speed equal to or higher than 1 m/sec was generated, that is, the case where the speed of the airflow was higher than the transport speed of the recording sheet, and thereby excellent fixing was performed. On the other hand, the occurrence of unevenness of the fixing was recognized in the case where the speed of the airflow was lower than 1 m/sec.

The foregoing description of the exemplary embodiment of the present invention has been provided for the purpose of illustration and description. It is not intended to be exhaustive or to limit the invention to the precise forms disclosed. Obviously, many modifications and various will be apparent to practitioners skilled in the art. The embodiments were chosen and described in order to best explain the principles of the invention and its practical application, thereby enabling other skilled in the art to understand the invention for various embodiments and with the various modifications as are suited to the particular use contemplated. Constituent components disclosed in the aforementioned embodiments may be combined suitable to form various modifications. It is intended that the scope of the invention be defined by the following claims and their equivalents.

What is claimed is:

1. A laser fixing device comprising:

a laser beam generating device that generates laser beams and irradiates a recording medium transported with the laser beams; and an airflow generating unit that generates airflow flowing between the laser beam generating device and the recording medium, wherein a flow speed of the airflow in a transport direction of the recording medium in an irradiation position of the laser beams is higher than a transport speed of the recording medium, wherein the laser fixing device further comprises a plate-shaped member that is disposed between the recording medium and the laser beam generating device to face the recording medium and transmits the laser beams, wherein the airflow generating unit generates the airflow flowing between the plate-shaped member and the recording medium, and wherein the plate-shaped member is disposed so that a gap between the plate-shaped member and a transport member that transports the recording medium is gradually decreased from an upstream side of the airflow toward the irradiation position of the laser beams or a position in the vicinity of the irradiation position.

2. A laser fixing device comprising:

a laser beam generating device that generates laser beams and irradiates a recording medium transported with the laser beams; and an airflow generating unit that generates airflow flowing between the laser beam generating device and the recording medium, wherein a flow speed of the airflow in a transport direction of the recording medium in an irradiation position of the laser beams is higher than a transport speed of the recording medium, wherein the laser fixing device further comprises a light collecting body that irradiates the irradiation position and a position in the vicinity of the irradiation position with a reflected light by reflecting a scattered light scattered in the irradiation position, wherein the light collecting body is divided into a plurality of light collecting parts in an irradiation range of the laser beams in a width direction of the recording medium, wherein each of the divided light collecting parts includes a cylindrical curved face, respective positions of center axes of the cylindrical curved faces are the common and respective radiuses of the cylindrical curved faces are different radiuses, wherein the cylindrical curved faces are disposed on a same side of the recording medium, and wherein the light collecting parts are disposed so that a center axis of the cylindrical curved face intersects with the irradiating position or a position in the vicinity of the irradiating.

3. An image forming apparatus comprising:

an image carrier on which an electrostatic latent image is formed in accordance with a difference between charged electric potentials;

a developing unit that forms a visible image by transferring an image forming material to the electrostatic latent image formed on the image carrier;

a transfer device that transfers the visible image directly to a recoding medium, or primarily transfers the visible image to a transfer body and secondarily transfers the visible image to the recording medium; and a laser fixing device that heats the visible image forming material of the image transferred to the recording medium, the laser fixing device includes:

a laser beam generating device that generates laser beams and irradiates a recording medium transported with the laser beams; and an airflow generating unit that generates airflow flowing between the laser beam generating device and the recording medium, wherein a flow speed of the airflow in a transport direction of the recording medium in an irradiation position of the laser beams is higher than a transport speed of the recording medium, wherein the laser fixing device further includes a plate-shaped member that is disposed between the recording medium and the laser beam generating device to face the recording medium and transmits the laser beams, wherein the airflow generating unit generates the airflow flowing between the plate-shaped member and the recording medium, and wherein the plate-shaped member is disposed so that a gap between the plate-shaped member and a transport member that transports the recording medium is gradually decreased from an upstream side of the airflow toward the irradiation position of the laser beams or a position in the vicinity of the irradiation position.

4. An image forming apparatus comprising:

an image carrier on which an electrostatic latent image is formed in accordance with a difference between charged electric potentials;

a developing unit that forms a visible image by transferring an image forming material to the electrostatic latent image formed on the image carrier;

a transfer device that transfers the visible image directly to a recoding medium, or primarily transfers the visible image to a transfer body and secondarily transfers the visible image to the recording medium; and a laser fixing device that heats the visible image forming material of the image transferred to the recording medium, the laser fixing device includes:

a laser beam generating device that generates laser beams and irradiates a recording medium transported with the laser beams; and an airflow generating unit that generates airflow flowing between the laser beam generating device and the recording medium, wherein a flow speed of the airflow in a transport direction of the recording medium in an irradiation position of the laser beams is higher than a transport speed of the recording medium, wherein the laser fixing device further includes a light collecting body that irradiates the irradiation position and a position in the vicinity of the irradiation position with a reflected light by reflecting a scattered light scattered in the irradiation position, wherein the light collecting body is divided into a plurality of light collecting parts in an irradiation range of the laser beams in a width direction of the recording medium, wherein each of the divided light collecting parts includes a cylindrical curved face, respective positions of center axes of the cylindrical curved faces are the same position and respective radiuses of the cylindrical curved faces are different radiuses, wherein the cylindrical curved faces are disposed on a same side of the recording medium, and wherein the light collecting parts are disposed so that a center axis of the cylindrical curved face intersects with the irradiating position or a position in the vicinity of the irradiating position.

* * * * *